US005704448A

United States Patent [19]

Jenkins, Jr.

[11] Patent Number: 5,704,448

[45] Date of Patent: Jan. 6, 1998

[54] MODULAR LADDER SYSTEM

[76] Inventor: Joseph Robert Jenkins, Jr., 6578 Waverly La., Lake Worth, Fla. 33467

[21] Appl. No.: 519,995

[22] Filed: Aug. 28, 1995

Related U.S. Application Data

[63] Continuation of Ser. No. 502,572, Jul. 14, 1995.

[51] Int. Cl.[6] ..... E06C 1/10

[52] U.S. Cl. ..... 182/93; 182/116

[58] Field of Search ..... 182/93, 116, 187, 182/206, 214, 107

[56] References Cited

U.S. PATENT DOCUMENTS

| | | | |
|---|---|---|---|
| 2,827,216 | 3/1958 | Napolitano | 182/195 X |
| 2,975,857 | 3/1961 | Suroff | 182/207 |
| 4,592,446 | 6/1986 | White | 182/93 |
| 5,277,273 | 1/1994 | Grimes | 182/187 |
| 5,509,499 | 4/1996 | Prejean | 182/93 |

OTHER PUBLICATIONS

"Speed Step", Alumitech. submitted by applicant as prior art.

*Primary Examiner*—Alvin C. Chin-Shue

*Attorney, Agent, or Firm*—Warner J. Delaune

[57] ABSTRACT

A modular ladder system for climbing trees is provided, comprising an upper assembly having a first pair of support members attached to one another by a top step; a lower assembly having a second pair of support members attached to one another by a bottom step; a central assembly having a third pair of support members and a third step, wherein the upper and lower assemblies are independently slidable relative to the central assembly; a first lock between the upper assembly and the central assembly for selectively locking the position of the upper assembly relative to the central assembly in an extended position and a retracted position; a second lock between the lower assembly and the central assembly for selectively locking the position of the lower assembly relative to the central assembly in an extended position and a retracted position; an attachment device on the upper assembly for attaching the ladder module to a tree; and a stabilizer on the upper assembly and the lower assembly for stabilizing the ladder module against the tree. In a preferred embodiment, a first portion of the stabilizer is attached to the top step, and a second portion of the stabilizer is attached to the bottom step, the top step is lockingly pivotable relative to the upper assembly; and the bottom step is lockingly pivotable relative to the lower assembly.

2 Claims, 13 Drawing Sheets

MODULAR LADDER SYSTEM

RELATION TO COPENDING APPLICATION

This application is a continuation of copending application Ser. No. 08/502,572 filed Jul. 14, 1995.

BACKGROUND OF THE INVENTION

I. Field of the Invention

The present invention relates generally to ladders, and more particularly to modular ladder systems for climbing trees.

II. Description of Prior Art

In the sport of hunting, especially when the quarry is deer, the use of a treestand is a very common practice. The treestand offers many advantages, such as enabling the hunter to view his surroundings from an elevated vantage point, and minimizing the chances of being spotted or smelled by the deer. Therefore, development of treestand technology to facilitate the achievement of these objectives has been quite progressive, focusing on both portability and adaptability. Despite the advances made in this filed, however, there still remains the problem of actually climbing the tree to set up the treestand, and a number of prior techniques have been attempted with varying levels of success. Several of these devices are explained below, and each one offers the hunter a unique balance of portability, strength, stability and adaptability to the tree-climbing environment.

The simplest ladder known in the prior art, other than simply using the branches of the tree, is the conventional ladder having two parallel members connected by perpendicular rungs. Whether such a ladder has a unitary construction or is a foldable extension ladder, it is extremely cumbersome for carrying through dense woods and is oftentimes quite heavy. Also, such ladders are necessarily straight, and they may not be well suited for use with a tree having an irregular shape. Finally, under the adverse conditions presented by most hunting environments, a conventional ladder is typically unstable and dangerous.

To overcome the problem of portability associated with conventional ladders, a number of alternative designs have been attempted. Some devices simply include two or more sections or modules of conventional ladder design which connect end-to-end, with the resulting assembly having one end resting on the ground and the other end (and/or mid-section) tied to the tree to improve stability. While these designs made headway in improving portability, they remain ill-suited for use with trees having an irregular vertical axis or many low branches which interfere with the long straight-line distance that the ladder is meant to span.

Another alternative design also comprises a number of connected modules, where each module has a single vertical member from which several steps are placed perpendicularly thereto. Some models have the steps offset from one another, such as in the case of the "Po-Jo Climbing Pole" manufactured by Amacker International, Inc., in Delhi, La. In other models, the steps are formed in a continuing T-configuration with respect to the vertical member, as seen in the "Sky Ladder" manufactured by Loc-On Company in Greensboro, N.C. The assembled ladder is then either tied to the tree with a rope or, or attached to the tree by a set of metal tongs. In those ladders where the steps are arranged in a continuing T-configuration, a purported advantage is that the climber is afforded the ability to place both feet on the same level while climbing, resulting in a more comfortable and stable climb.

Despite their apparent advantages, none of the above devices have addressed the problem of trees which have: (1) so-called "bell bottoms", or unusually wide trunks, such as cypress and tupelo trees typical in the southern United States; (2) a main vertical axis which is very irregular; or (3) many low-level branches which do not allow for a continuous ladder spanning a large distance to the treestand.

However, the ladder modules marketed under the trademark "Speed Steps" by Alumitech Industries, Inc., in Mamou, La., are an attempt to overcome those unique concerns. That ladder system is essentially a number of mini-ladders of conventional design which are separately attachable to the tree, except that the tips of the parallel rails at both ends are curved toward the tree to provide a four-point contact. While that device is an improvement over prior devices to some extent, the modules are not individually adjustable in any way, so they cannot make maximum use of the existing tree structure, and they cannot be made more compact for storage and transportation.

As a solution to most of the aforementioned problems, the inventor herein has previously developed a single-pole, modular ladder system, wherein some of the ladder modules may be separately adjustable between a retracted position and an extended position, as disclosed in U.S. Pat. No. 5,439,072, issued on Aug. 8, 1995. However, some hunters still prefer a double-rail type of ladder over a single-pole approach for safety reasons. For example, a double-rail design provides side-to-side protection against slippage from the ladder rungs, and it allows the hunter to grip the rails with both hands while climbing. What is now needed, therefore, is a double-rail, modular tree ladder system which is conveniently portable, strong, stable, and adaptable to a variety of tree climbing environments.

SUMMARY OF THE INVENTION

It is therefore an object of this invention to provide a portable tree ladder system which is strong, compact and lightweight.

It is also an object of this invention to provide a portable tree ladder system which is highly adaptable to the particular tree climbing situation.

It is a further object of this invention to provide a portable tree ladder system whose modules are adjustable in length.

Yet another object of this invention is to provide a portable tree ladder system which is safe and stable when used.

These and other objects and advantages of the present invention will no doubt become apparent to those skilled in the art after having read the following description of the preferred and alternate embodiments, which are contained in and illustrated by the various drawing figures.

Therefore, in a preferred embodiment, a modular ladder system for climbing trees is provided, comprising an upper assembly having a first pair of support members attached to one another by a top step; a lower assembly having a second pair of support members attached to one another by a bottom step; a central assembly having a third pair of support members and a third step, wherein the upper and lower assemblies are independently slidable relative to the central assembly; a first lock between the upper assembly and the central assembly for selectively locking the position of the upper assembly relative to the central assembly in an extended position and a retracted position; a second lock between the lower assembly and the central assembly for selectively locking the position of the lower assembly relative to the central assembly in an extended position and a retracted position; an attachment device on the upper assembly for attaching the ladder module to a tree; and a stabilizer on the upper assembly and the lower assembly for stabilizing the ladder module against the tree. In a preferred embodiment, a first portion of the stabilizer is attached to the top step, and a second portion of the stabilizer is attached to the bottom step, the top step is lockingly pivotable relative to the upper assembly; and the bottom step is lockingly pivotable relative to the lower assembly. Optionally, upper and lower non-slip surfaces are provided for all steps, and retaining tabs are located at the ends of the top and bottom steps to aid in keeping the climber's shoes from inadvertently leaving the ladder module.

DETAILED DESCRIPTION OF THE INVENTION

Figure 1A:
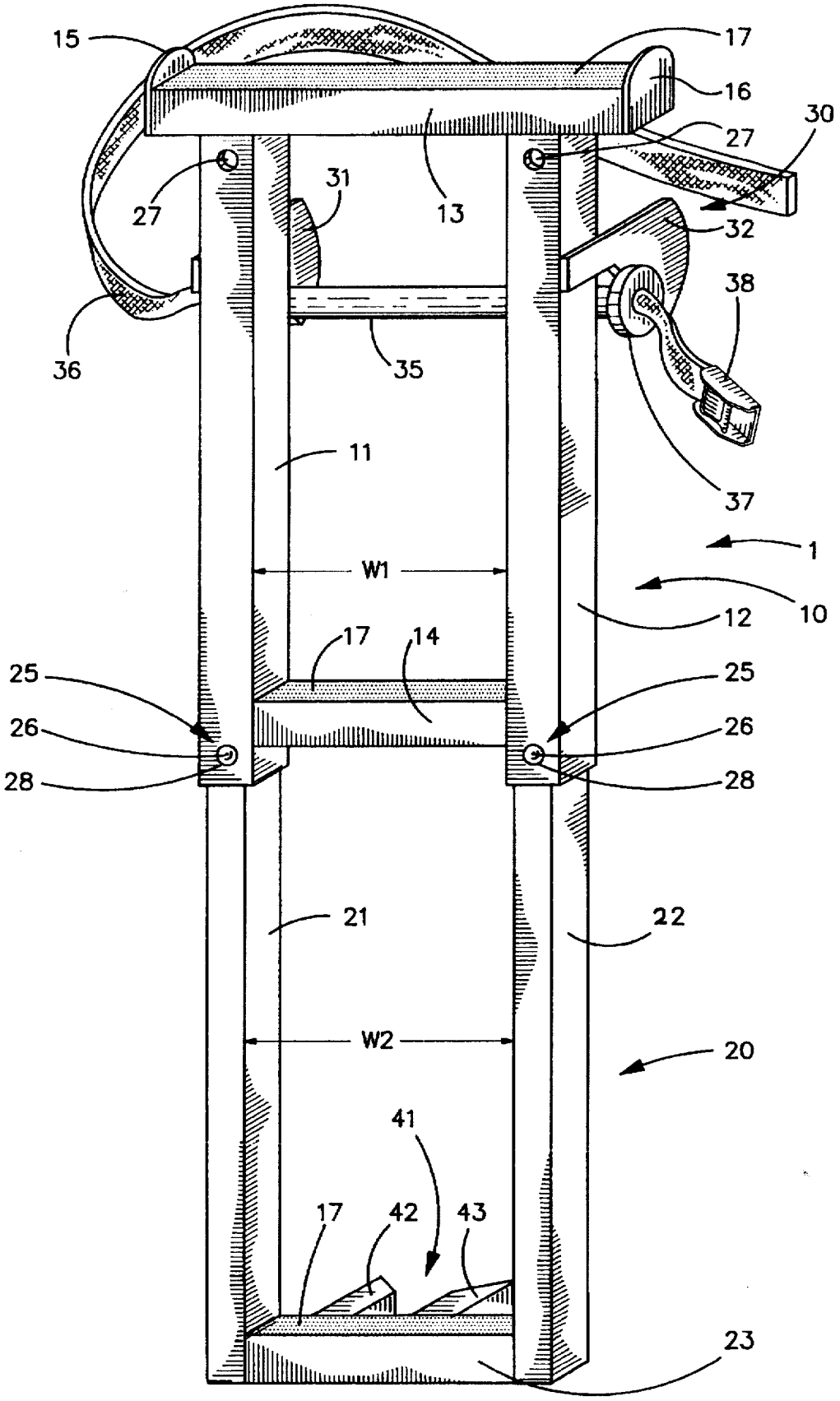
FIGS. 1A and 1B are perspective views of one embodiment of the invention in an extended position and a retracted position, respectively.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. Also, the spreading use of electron beam welding eliminates many such features and leaves no visible distinctive lines. Unless otherwise noted, all elements are preferably constructed from lightweight aluminum tubing and attached to one another by welding, although a variety of other materials and assembly methods may also be used.

Figure 1B:
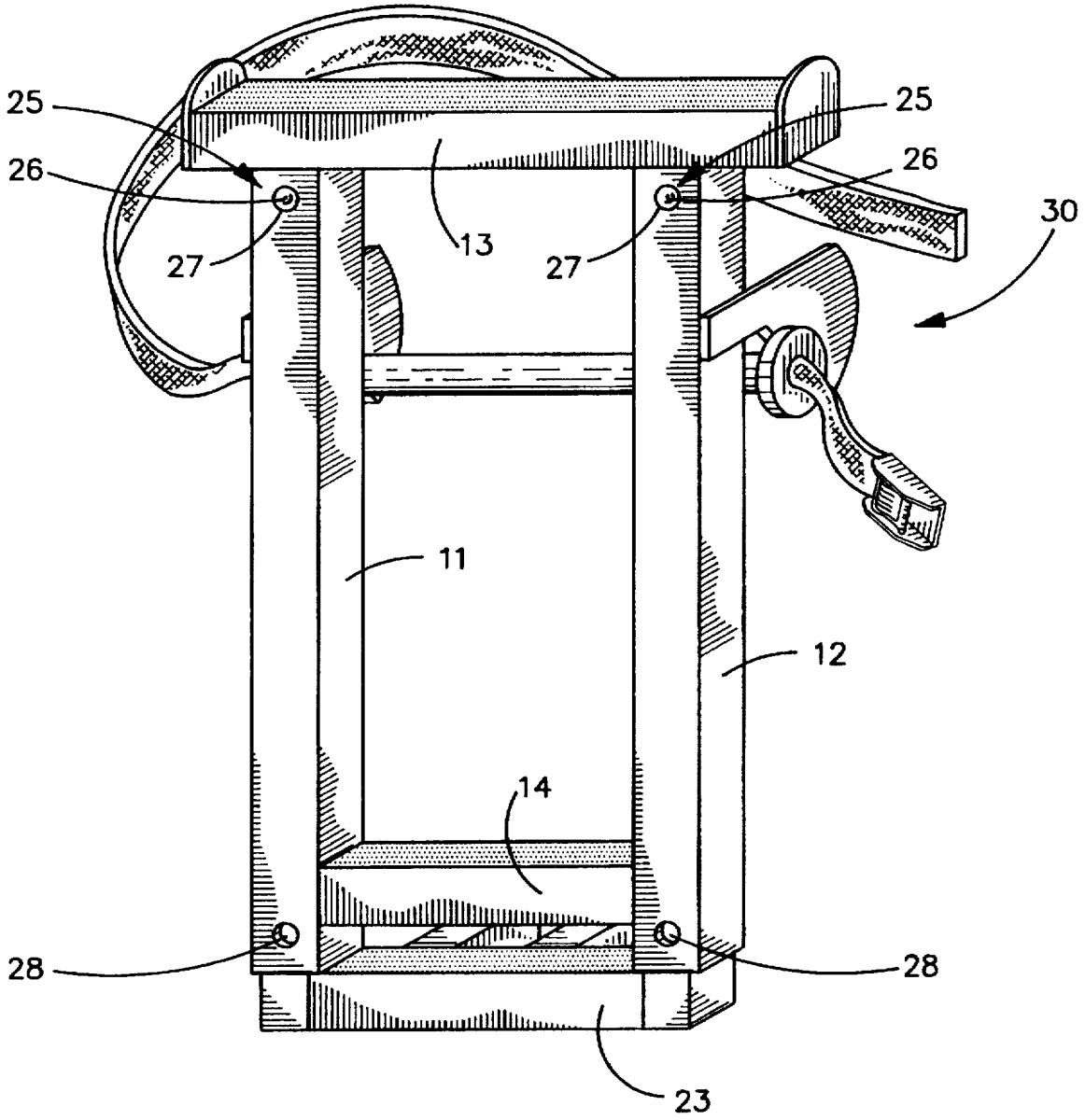

Turning now to FIG. 1A and 1B, one embodiment of the inventive tree ladder module 1 is shown which can be adjusted to suit the needs of the climber, generally comprising an upper assembly 10 and a lower assembly 20. Upper assembly 10 is comprised of parallel support members 11,12 which are connected to one another by top step 13 and middle step 14. Top step 13 and middle step 14 are attached substantially perpendicularly between parallel support members 11,12, with top step 13 being located at the upper ends of parallel support members 11,12 and middle step 14 being located near the lower ends of parallel support members 11,12. Parallel support members 11,12 are separated by a distance which is defined by the width W1 of middle step 14, which should be no wider than a single large shoe or boot. Less preferably, the width W1 of middle step 14 can also be made wide enough to accommodate both shoes, but at the sacrifice of some degree of portability. Top step 13, however, is preferably wide enough to accommodate both shoes so that a climber can stand comfortably with both feet at the same level.

For reasons of safety, top step 13 includes retaining tabs 15,16 rigidly attached to the ends of top step 13, which help to prevent slippage of the climber's shoe from the ladder module 1 during climbing. As an added safety feature, top step 13 and middle step 14 should also include a non-slip, or abrasive, surface 17 for contact with the sole of the climber's shoe. Non-slip surface 17 can be added by any one of several methods widely known to those of ordinary skill, such as by an abrasive paint, an adhesive strip having embedded abrasive material, or by forming irregularities into steps 13,14 during manufacturing.

Lower assembly 20 is comprised of a second pair of parallel support members 21,22 which are connected to one another by bottom step 23. Bottom step 23 is attached substantially perpendicularly between parallel support members 21,22 and located at the lower ends of parallel support members 21,22, as shown in FIG. 1A and 1B. Similar to the upper assembly 10, the parallel support members 21,22 of the lower assembly 20 are separated by a distance which is defined by the width W2 of bottom step 23, which should be no wider than a single large shoe or boot. For the same reasons as in the upper assembly 10, the width W2 of bottom step 23 can be made wide enough to accommodate both shoes, but with some sacrifice in portability. Finally, bottom step 23 preferably includes a non-slip surface 17 of the type described previously herein.

Importantly, the width W2 between support members 21,22 and the width W1 between support members 11,12 are such that the support members 21,22 of the lower assembly 20 are telescopingly slidable within the support members 11,12 of upper assembly 10. Therefore, support members 21,22 must have cross sectional shapes which will slide into and out of support members 11,12. Preferably, there should be a relatively tight fit between upper assembly 10 and lower assembly 20, so that when the ladder module 1 is in an extended position, there will be little movement between upper assembly 10 and lower assembly 20.

In a retracted position as shown in FIG. 1B, lower assembly 20 is held almost entirely within upper assembly 10 by locking means 25. Locking means 25 can be any device on either upper assembly 10 or lower assembly 20 which effectively prevents lower assembly 20 from sliding out of upper assembly 10, such as a nut and bolt combination, or a spring loaded pin 26. If spring loaded pins 26 are employed, each of support members 11,12 will include a first lock hole 27 near top step 13 and a second lock hole 28 near middle step 14. Spring loaded pins 26 are located on each of support members 21,22 to engage either first lock holes 27 (thereby placing lower assembly 20 in a retracted position) or second lock holes 28 (thereby placing lower assembly 20 in an extended position, as shown in FIG. 1A). Of course, additional intermediate positions along the length of support members 11,12 are possible by the formation of more lock holes, although the simple two-position design described above is sufficient for most purposes. To ensure stability, the relative locations of first and second lock holes 27,28 and spring loaded pins 26 should be such that at least two inches (2") of support members 21,22 should remain within support members 11,12 in an extended position.

In keeping with the goals of being lightweight and portable, the overall length of ladder module 1 is approximately three feet (3') in an extended position and approximately twenty-one inches (21") in a retracted position, which makes it quite easy to be carried during a hunting trip. Therefore, upper assembly 10 and lower assembly 20 should each be approximately twenty inches (20") in length, although the proportions between these two assemblies may vary somewhat without departing from the invention.

To ensure that the ladder module 1 is anchored firmly to the tree and to provide a means for spacing the ladder module 1 away from the tree to leave room for the climber's shoes, attachment means 30 is located on upper assembly 10. As shown in FIGS. 1A, 1B, 4A, and 4B, attachment means 30 comprises a pair of hook portions 31,32 rigidly attached to and extending from the support members 11,12 of upper assembly 10. Each of hook portions 31,32 includes a front convex edge 33 for contacting a tree 40 and an inside inclined edge 34 for contacting a relatively stationary object as will be described shortly. The curvature of convex edge 33 is such that hook portions 31,32 can be firmly seated against virtually any irregular surface of a tree 40, but while doing very little damage to the tree 40 during installation and use of ladder module 1. Hollow member 35 is a section of semi-rigid material, such as a durable plastic, and is longer than the distance between hook portions 31,32 and is affixed to the tree 40 by strap 36, or any suitably strong flexible member, which is preferably threaded through hollow member 35. When installed, hollow member 35 serves to protect strap 36, although it may not be required if strap 36 is constructed of a suitably strong material, such as a metal cable. Strap 36 is attached to itself around the circumference of tree 40 by a self-tightening, quick release buckle 38. Hollow member 35 is also offset a short distance from tree 40 by a pair of spacers 37 located on 36. The inclined edges 34 of hook portions 31,32 contact the hollow member 35 during installation and use, and they act as a wedge to firmly suspend ladder module 1 from strap 36. Thus, the greater weight that is placed on ladder module 1, the tighter the hold between hook portions 31,32 and strap 36.

Stabilizing means 41 is also located on lower assembly 20 to assist hook portions 31,32 in keeping the climber's shoes away from the tree 40, and to lend stability to the lower end of ladder module 1. Stabilizing means 41 may simply comprise a pair of pointed tubing sections 42,43 extending from the bottom step 23 (as shown in FIG. 1A) or from support members 21,22. Providing at least four points of contact against the tree 40 (by tubing sections 42,43 and hook portions 31,32) prevents the ladder module 1 from moving relative to the tree 40 and creates a more stable structure.

Figure 2A:
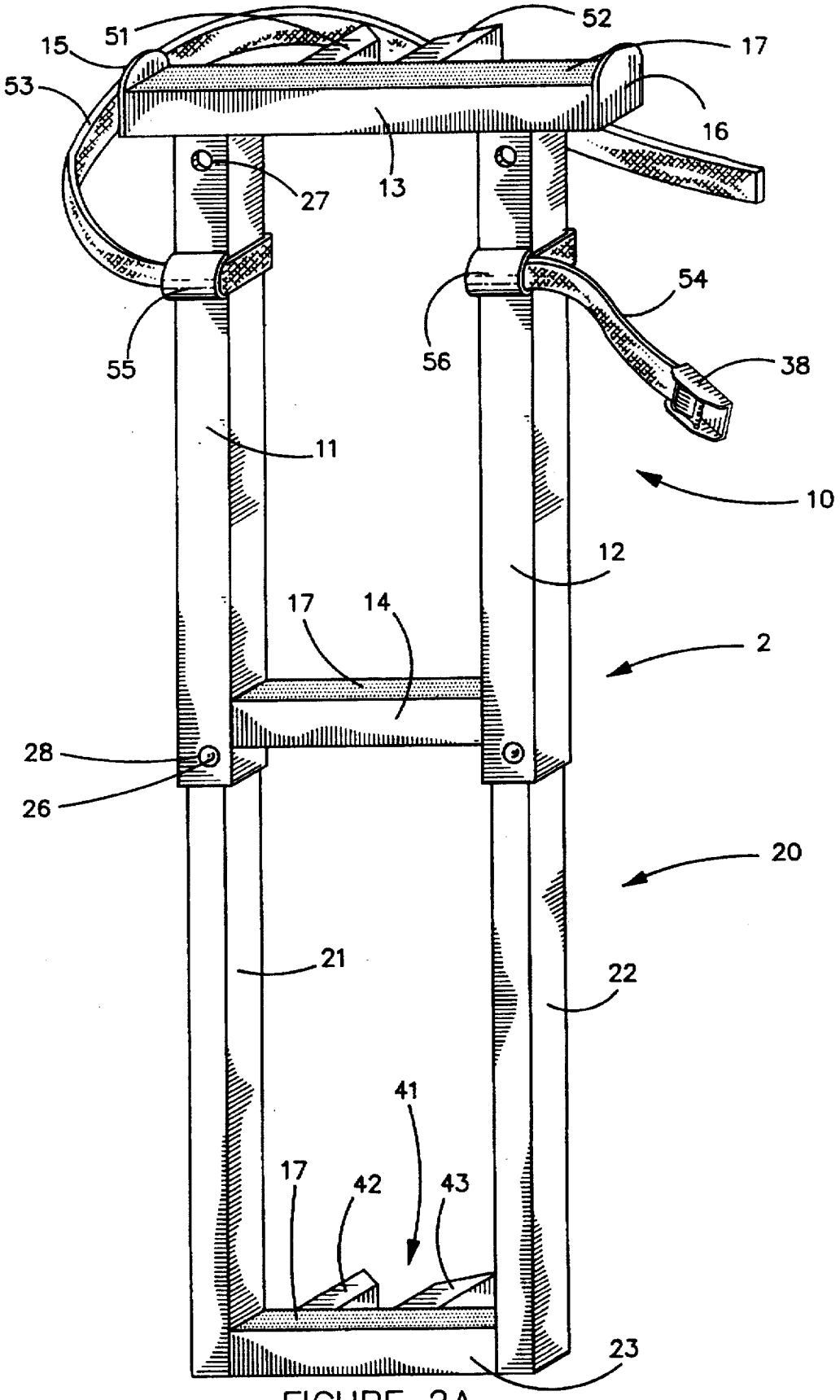
FIGS. 2A and 2B are perspective views of an alternative embodiment of the invention in an extended position and a retracted position, respectively.
Figure 2B:
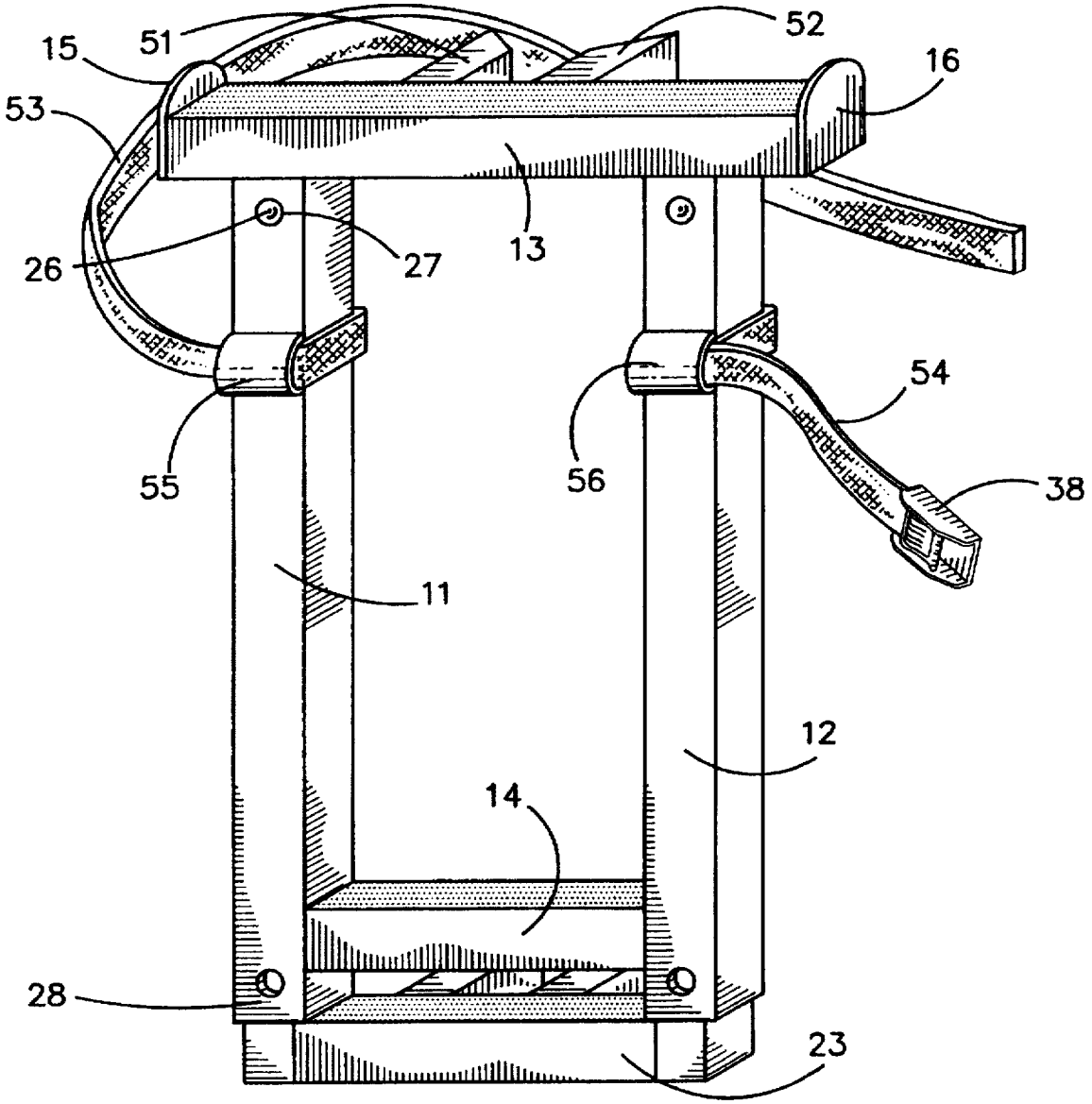

An alternative embodiment 2 of the invention is depicted in FIGS. 2A and 2B in an extended position and a retracted position, respectively. Ladder module 2 differs from the first embodiment 1 in the manner of its attachment to a tree 40. Rather than using the single strap 36 and hook portions 31,32, ladder module 2 employs two strap sections 53,54 and another pair of pointed tubing sections 51,52 extending from top step 13 (as shown in FIG. 2A) or from support members 11,12. Each of strap sections 53,54 are tied, or otherwise strapped in any suitable manner, around its respective support member 11,12 and through loops 55,56 formed onto support members 11,12, respectively. Loops 55,56 are positioned between top step 13 and middle step 14 so that strap sections 53,54 are not obstructed by top step 13 when the ladder module 2 sags under the weight of the climber. Quick release buckle 38 is attached to one end of either strap section 53 or 54 so that the strap sections 53,54 can be securely joined around the circumference of the tree 40. As can be seen, this alternative embodiment also benefits from the four points of contact against the tree 40, and is somewhat simpler to attach to the tree 40 than the previous embodiment. It also allows the climber to place both shoes onto the double-width top step 13.

Figure 3A:
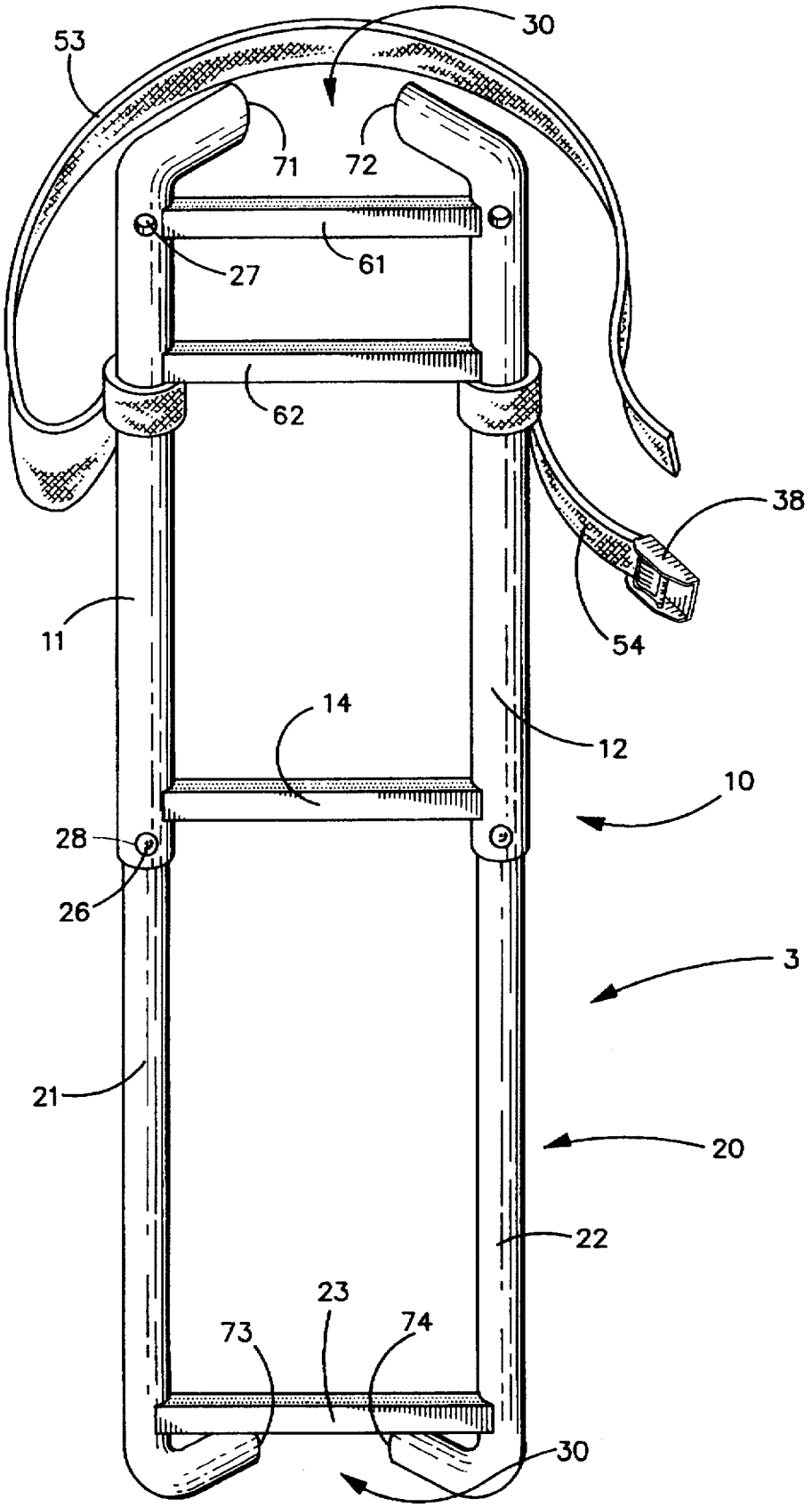
FIGS. 3A and 3B are perspective views of another alternative embodiment of the invention in an extended position and a retracted position, respectively.
Figure 3B:
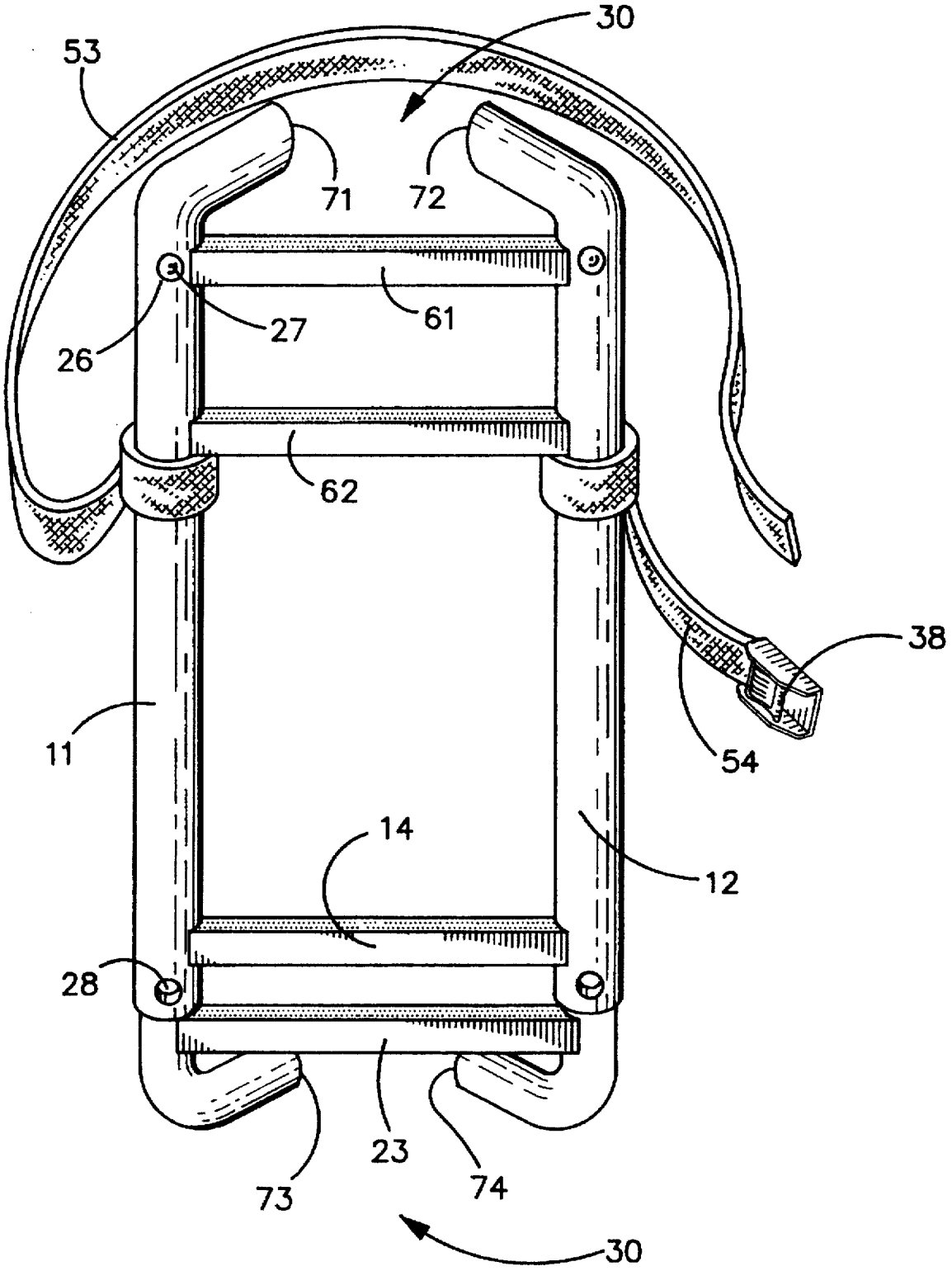
Figure 4A:
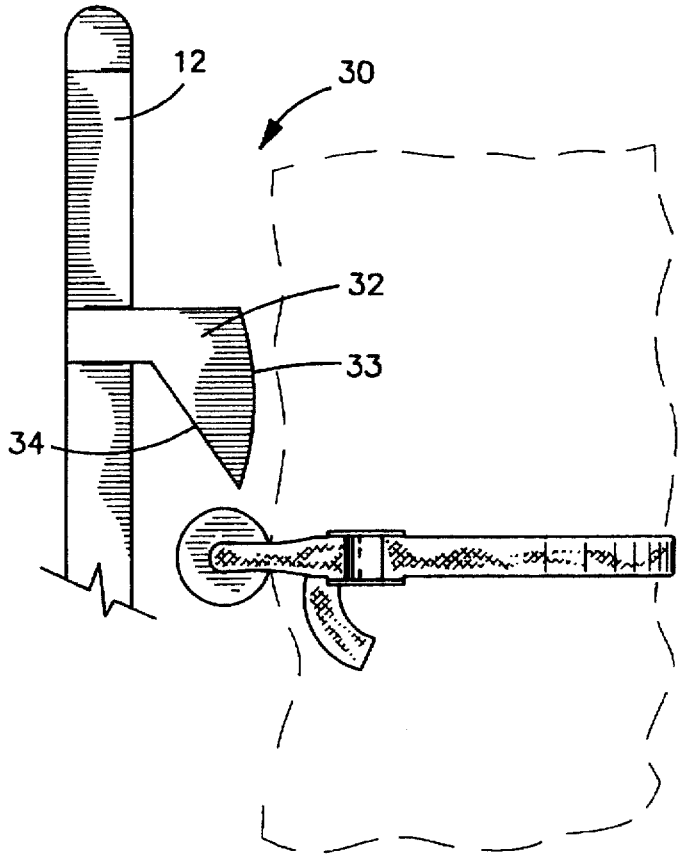
FIGS. 4A and 4B show the quick attachment feature which can be employed with any of the embodiments of the invention.
Figure 4B:
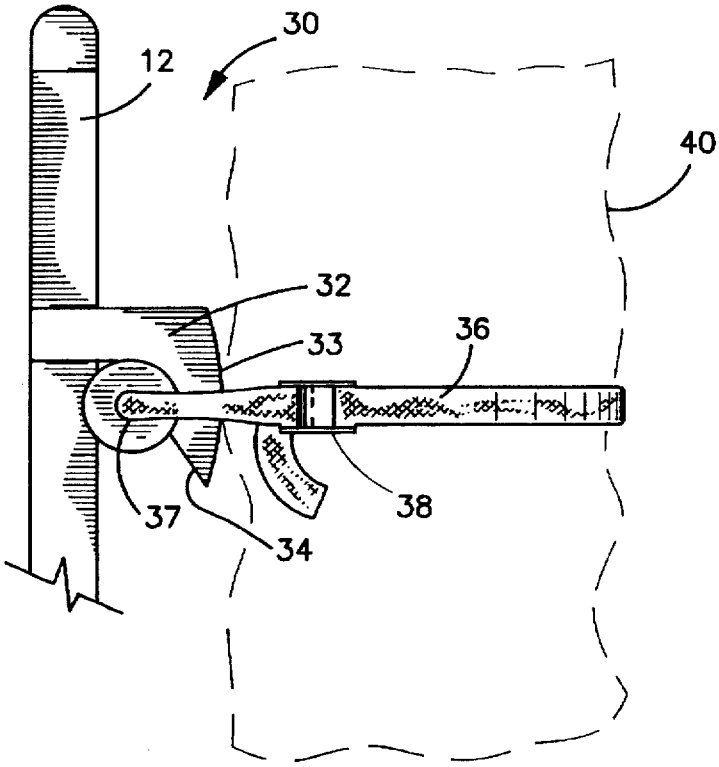

Another alternative embodiment 3 of the invention is shown in FIGS. 3A and 3B in an extended position and a retracted position, respectively. Ladder module 3, depicted as using round aluminum tubing, is similar to the previous embodiments 1,2 in terms of adjustability, and employs essentially the same method of attachment to the tree 40 as the second embodiment 2. However, ladder module 3 differs from the previous embodiments 1,2 in three key respects. First, the double-width top step 13 is replaced by two smaller steps 61,62 placed one over the other. The distance between steps 61,62 should be sufficient to allow passage of a large boot therebetween during climbing. This design requires the climber to place each foot on a separate step, but results in a thinner, more maneuverable ladder module. Second, the stabilizing means 30 is formed by bending the extreme ends 71,72 of support members 11,12 of upper assembly 10 and the extreme ends 73,74 of support members 21,22 of lower assembly 20 inward and toward the tree 40. Preferably, all four ends 71–74 are beveled to create a sharp or pointed area of contact with the tree 40. Finally, because of the presence of step 62, strap sections 53,54 may be tied, or otherwise strapped in any suitable manner, to support members 11,12 without the use of loops 55,56. As in the previous embodiment, quick release buckle 38 is attached to one end of either strap section 53 or 54 so that the strap sections 53,54 can be securely joined around the circumference of the tree 40.

Figure 5A:
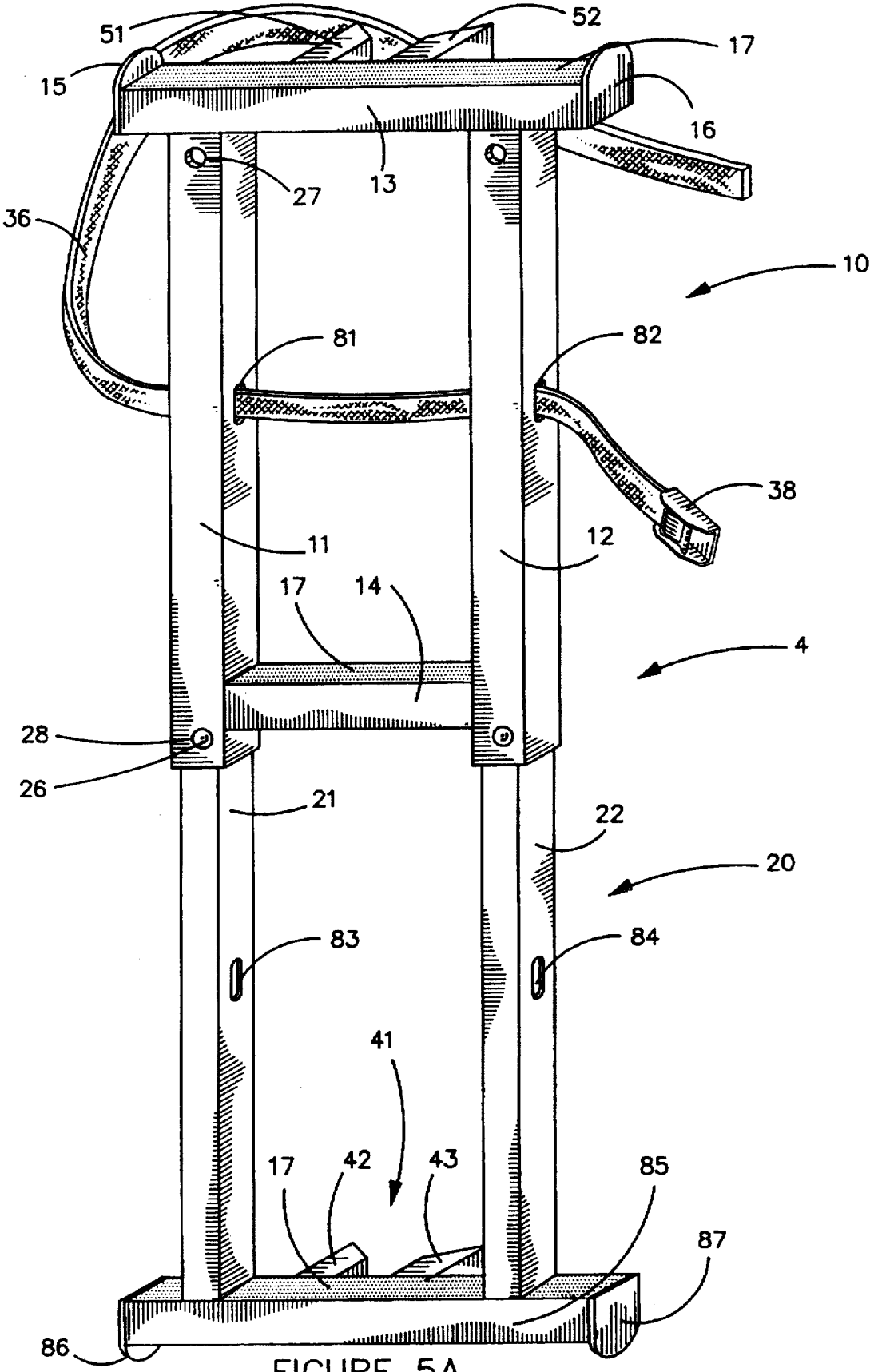
FIGS. 5A and 5B depict a another embodiment of the invention which can be used in either an upright or an inverted orientation.
Figure 5B:
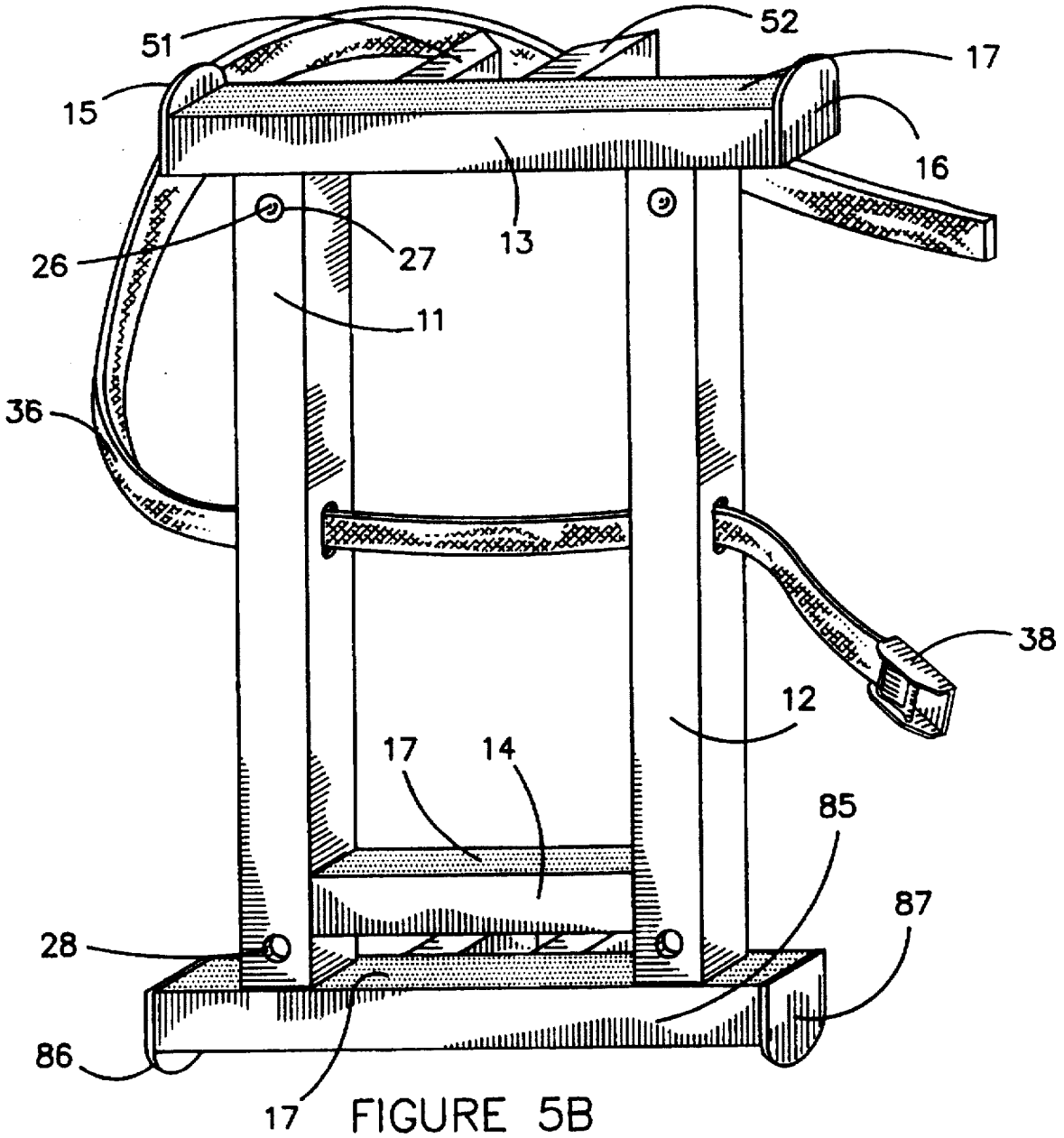

A preferred embodiment 4 of the invention is depicted in FIGS. 5A and 5B which can be used in either an upright or inverted orientation, as will be explained below. This embodiment is similar in many respects to the embodiment 2 of FIGS. 2A and 2B, and corresponding part numbers are used where applicable. Therefore, a description of the distinguishing features of the preferred embodiment 4 from the embodiment 2 of FIGS. 2A and 2B shall suffice. First, loops 55,56 are replaced by upper slots 81,82 formed completely through support members 11,12. Upper slots 81,82 are horizontally aligned with one another and are located at approximately the midpoint of the lengths of support members 11,12. Thus, as can be seen in FIG. 5A, a single strap 36 (such as that shown in FIGS. 1A and 1B) may be passed through upper slots 81,82 to secure the ladder module 4 in an extended position to a tree.

Additionally, lower slots 83,84 are formed completely through support members 21,22. Similar to upper slots 81,82, lower slots 83,84 are also horizontally aligned with one another and are located at approximately the midpoint of the lengths of support members 21,22. Importantly, the precise location of upper slots 81,82 and lower slots 83,84 along their respective support members are such that lower slots 83,84 become horizontally aligned with upper slots 81,82 when lower assembly 20 is retracted and locked into upper assembly 10. Therefore, the ladder module 4 is easily securable to a tree by passing strap 36 through aligned slots 81–84 in a retracted position, as shown in FIG. 5B.

From the foregoing description, it can be seen that strap 36 may be passed only through lower slots 83,84 if desired, so that ladder module 4 can be used with equal effectiveness in an extended position, but in an "inverted" (as opposed to an "upright") orientation. For the purposes of this description, "upright" is defined as an orientation of ladder module 4 wherein upper assembly 10 resides above lower assembly 20. Conversely, "inverted" is defined as an orientation of ladder module 4 wherein upper assembly 10 resides below lower assembly 20. Similarly, ladder module 4 can be secured to a tree in an inverted and retracted position for the same reasons explained above. Thus, the versatility of ladder module 4 is greater than that of the previously described embodiments.

Consistent with the ability of ladder module 4 to be used in an inverted position, the bottom step 23 of FIGS. 2A and 2B is replaced by a bottom step 85 identical to top step 13, although positioned so that retaining tabs 86,87 are directed in an opposite direction from retaining tabs 15,16. Likewise, the top and bottom surfaces of top step 13, middle step 14, and bottom step 85 include a non-slip surface 17, as previously described herein, so that a climber can have sure footing on ladder module 4 in either an upright or inverted position.

Figure 6:
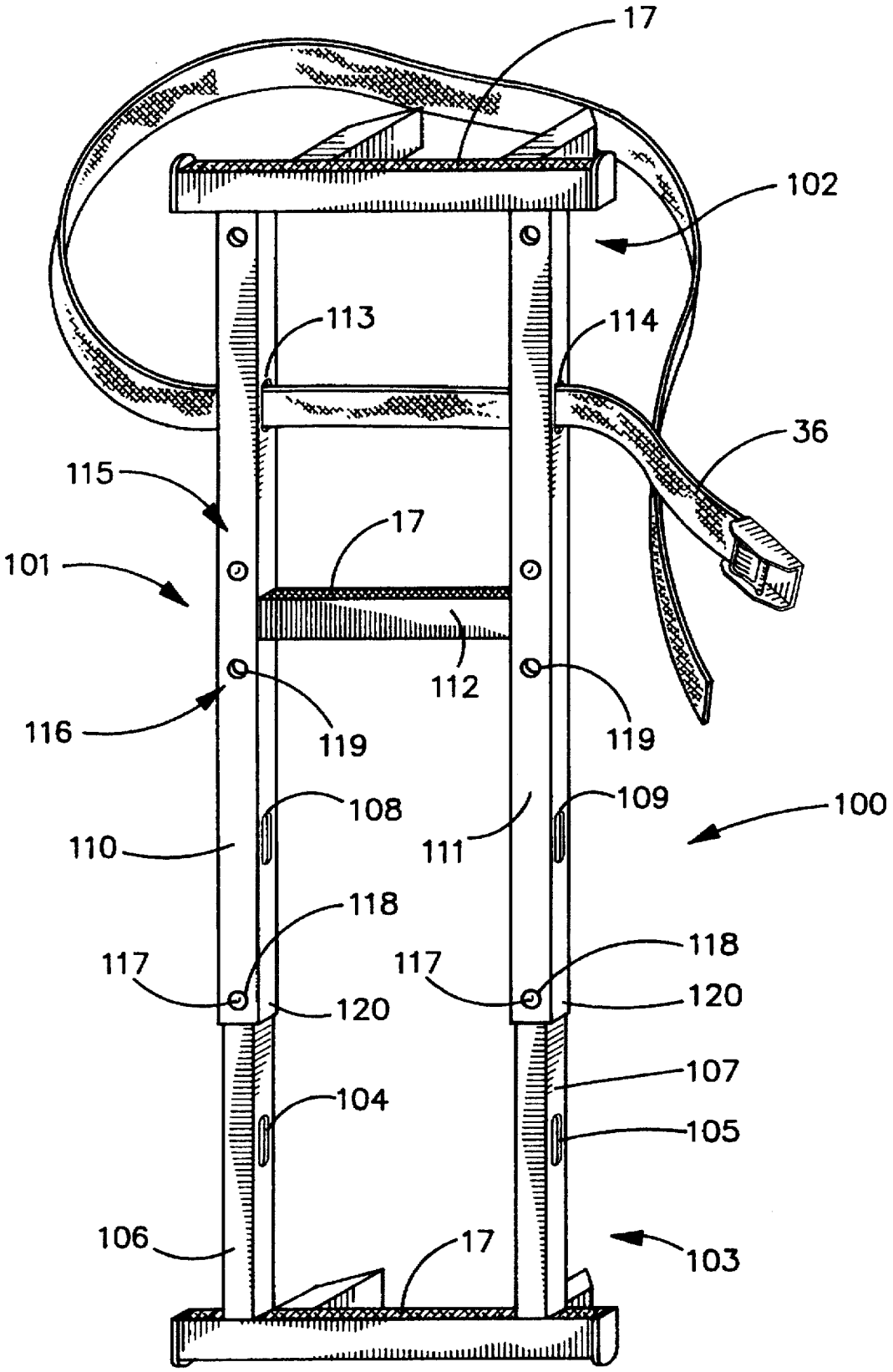
FIG. 6 is a perspective view of a further embodiment of the invention having opposing extendable and retractable sections.

FIG. 6 illustrates another embodiment 100 of the present invention which generally includes a central assembly 101, an upper assembly 102, and a lower assembly 103. In this embodiment, upper assembly 102 and lower assembly 103 are constructed identical to one another, and each is independently and telescopingly slidable relative to central assembly 101. In FIG. 6, upper assembly 102 is shown in a retracted position, while lower assembly 103 is shown in an extended position. Because upper and lower assemblies 102,103 are identical, a user may interchangeably use upper assembly 102 in place of lower assembly 103, and vice versa. Therefore, a description of lower assembly 103 will suffice for upper assembly 102 as well.

Lower assembly 103 is identical in most respects to lower assembly 20 of FIG. 5A and 5B, with the exception of its length and the location of slots 104,105. As in the other embodiments described herein, the overall length of the ladder module should be approximately three feet (3') in a fully extended configuration, while the overall length should be twenty-two inches (22") or less in a fully retracted configuration. Therefore, upper assembly 102 and lower assembly 103 should each be approximately eleven inches (11") in length, while central assembly 101 should be approximately nineteen inches (19") in length. Accordingly, slob 104,105 should be located at about five and one-half inches (5½") along the length of support members 106,107, respectively, to align with slots 108,109 in central assembly 101 as will be explained further below.

Central assembly 101 is an H-shaped assembly comprising a third step 112, having an upper and lower non-slip surface 17, attached between a pair of support members 110,111 which are similar to support members 11,12 of FIG. 5A in terms of material and cross-sectional size. Specifically, support members 110,111 are sized in a manner to allow support members 106,107 of lower assembly 103 to telescopingly slide within support members 110,111. There should be a relatively tight fit between central assembly 101 and lower assembly 103, so that when the lower assembly 103 is in an extended position, there will be little movement between central assembly 101 and lower assembly 103. For reasons of symmetry, these same requirements apply to the relationship between upper assembly 102 and central assembly 101. As stated previously, slots 108,109 are formed into support members 110,111 of central assembly 101 at a location such that a precise alignment is achieved between slots 108,109 and slots 104,105 when lower assembly 103 is in a retracted position. A second pair of slots 113,114 are formed through support members 110,111 to align with corresponding slots (not shown) in upper assembly 102. Alignment in this manner permits the use of strap 36 through the appropriate slots to attach the ladder module to a tree regardless of the particular configuration desired by the user.

Figure 7:
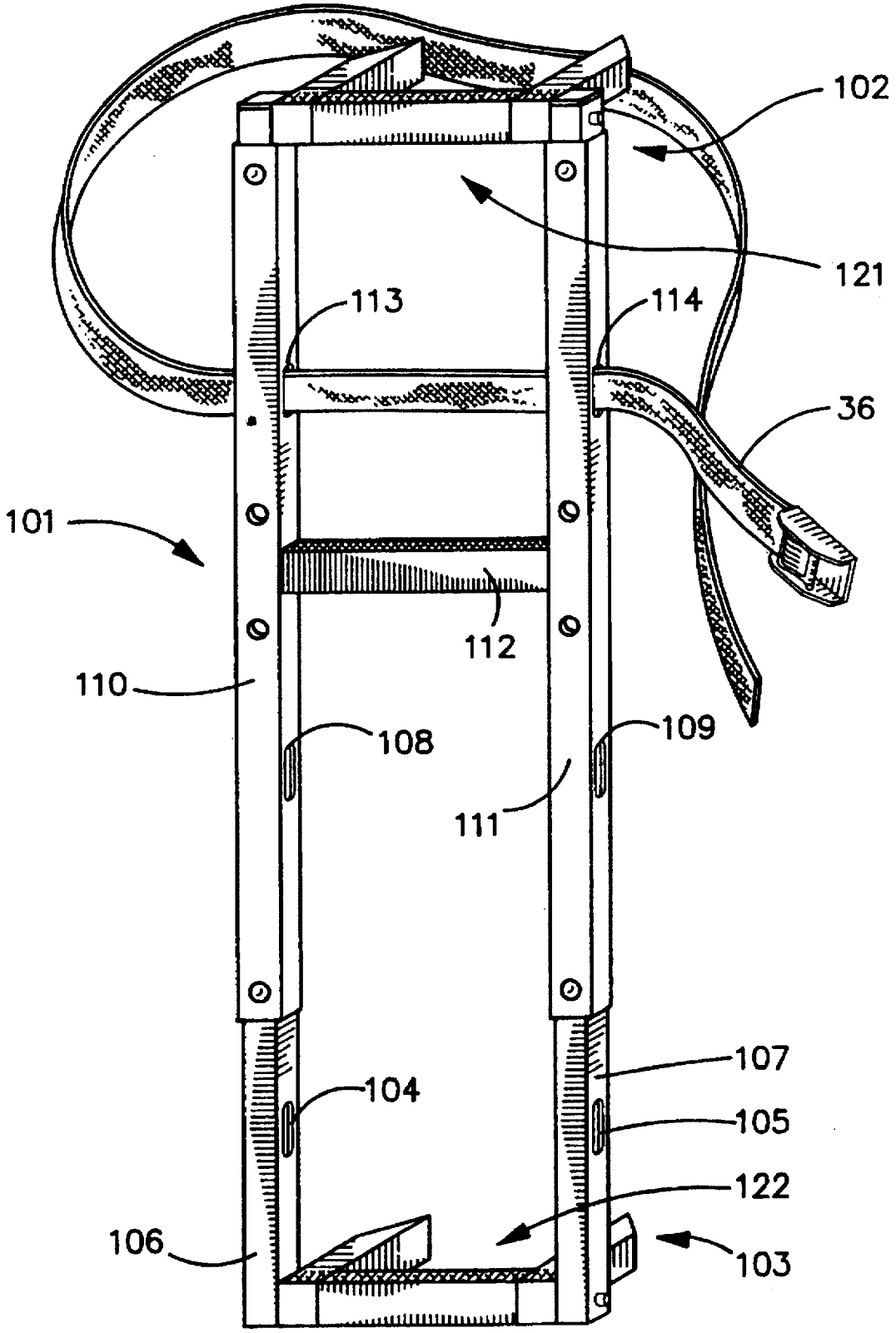
FIG. 7 is a perspective view of the embodiment of FIG. 6 in which the top and bottom steps have been replaced by collapsible steps.
Figure 8:
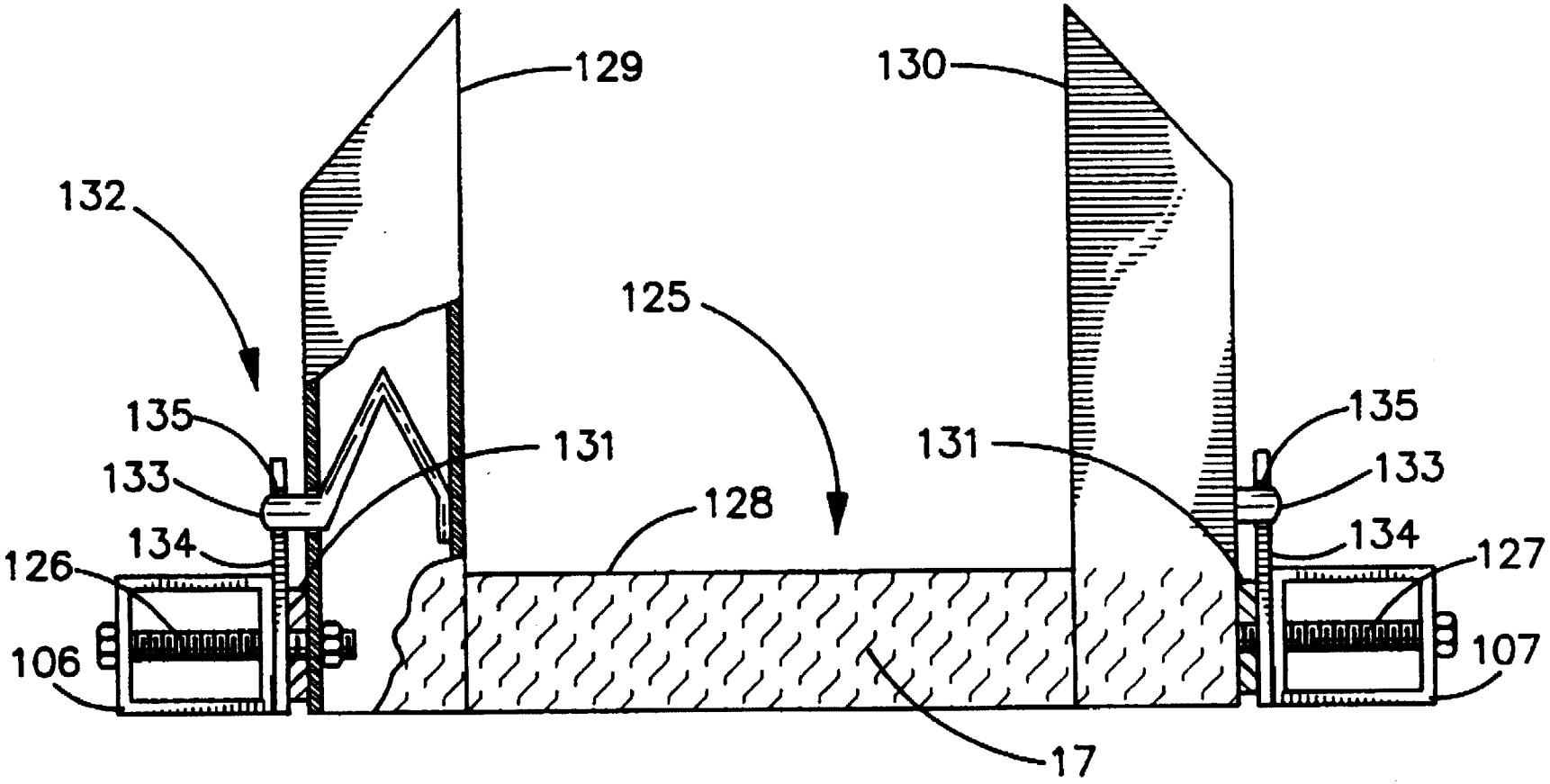
FIG. 8 is a bottom view of the embodiment of FIG. 7 depicting the details of the collapsible steps.
Figure 9:
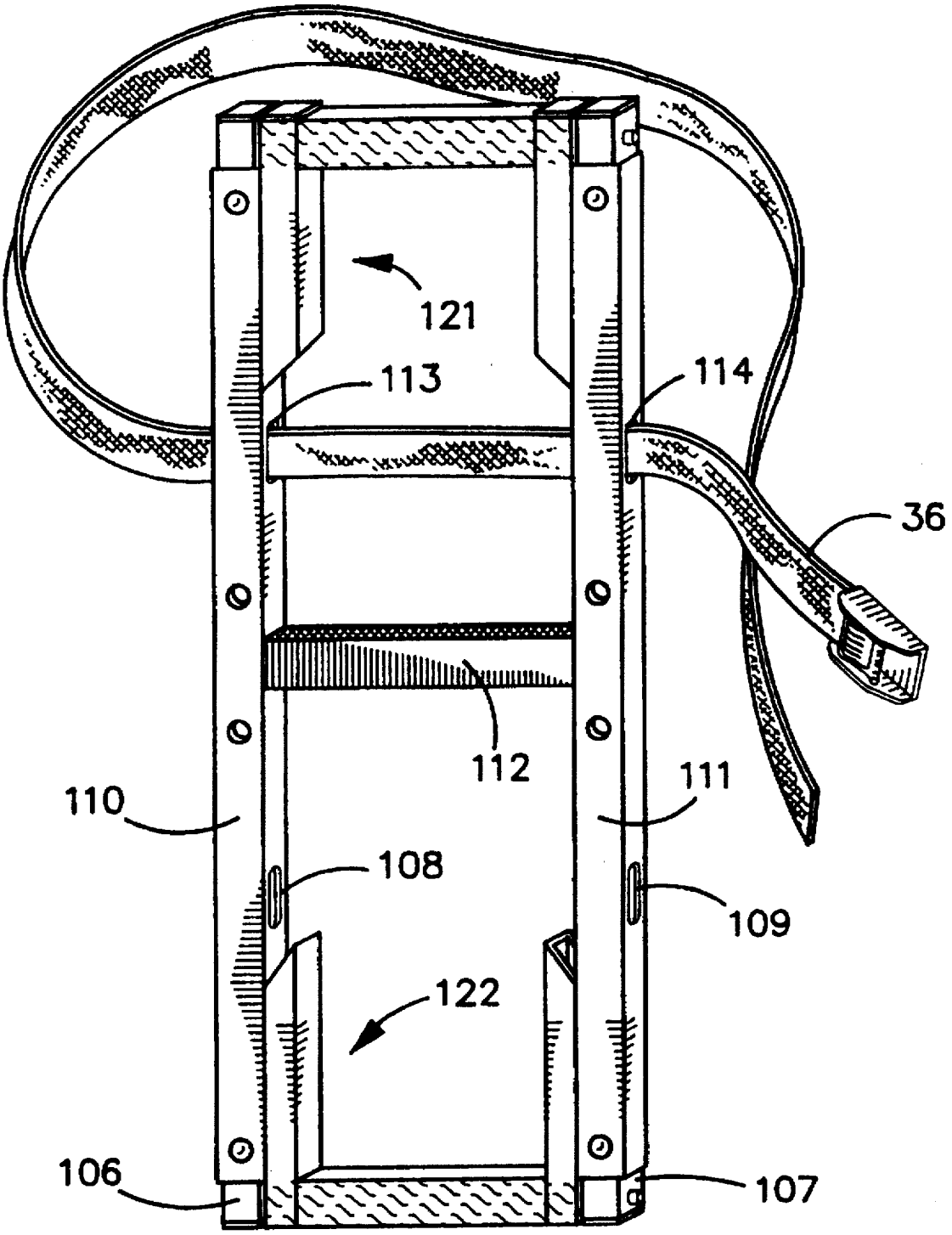
FIG. 9 is a perspective view of the embodiment of FIG. 7 in a completely retracted and collapsed configuration for transportation and storage.

Separate, but identical, locking means 115,116 are required for the operation of upper assembly 102 and lower assembly 103, respectively. Locking means 116 can be any device on either lower assembly 103 or central assembly 101 which effectively prevents lower assembly 103 from sliding relative to central assembly 101, such as a nut and bolt combination, or a spring loaded pin 117. If spring loaded pins 117 are employed, each of support members 110,111 will include a first lock hole 118 near their distal ends 120 and a second lock hole 119 near third step 112. Spring loaded pins 117 are located on each of support members 106,107 to engage either first lock holes 118 (thereby placing lower assembly 103 in an extended position, as shown in FIG. 6) or second lock holes 119 (thereby placing lower assembly 103 in a retracted position). Once again, additional intermediate positions along the length of support members 106,107 are possible by the formation of more lock holes, although the simple two-position design described above is sufficient for most purposes. To ensure stability, the relative locations of first and second lock holes 118,119 and spring loaded pins 117 should be such that at least two inches (2") of support members 106,107 should remain within support members 110,111 in an extended position. As mentioned previously, locking means 115 between central assembly 101 and upper assembly 102 is symmetrically identical in structure and function to locking means 116 just described. Finally, FIGS. 7–9 depict the same embodiment of FIG. 6, but with top and bottom steps 121,122 which pivot relative to their respective assembly 102,103. The details of either of pivoting steps 121,122 are best seen in FIG. 8, which is a partial sectional view either of pivoting step 121 from a top view of FIG. 7 or of pivoting step 122 from a bottom view of FIG. 7. For the following description, FIG. 8 will be described for pivoting step 122 with the understanding that an identical arrangement exists for pivoting step 121. Generally speaking, support members 106,107 are held to one another by the interaction of step member 125 and nut and bolt members 126,127. Step member 125 includes a step 128, having upper and lower non-slip surfaces 17, rigidly attached between a pair of pointed tubing sections 129,130 which serve to stabilize one end of the ladder module against a tree. Nut and bolt member 126 rotatably secures tubing section 129 to support member 106, while nut and bolt member 127 rotatably secures tubing section 130 to support member 107. Thus, step member 125 is allowed to pivot about the axis created by nut and bolt members 126,127. Preferably, a washer 131 of durable synthetic material is located at the interface between step member 125 and support members 106,107 in order to reduce the wear associated with pivoting.

Step member 125 and its stabilizing tubing sections 129,130 are maintained in an operating position by locking means 132 operatively disposed between support members 106,107 and tubing sections 129,130. Locking means 132 can be any device which effectively prevents step member 125 from rotating relative to support members 106,107, such as a nut and bolt combination, or a spring loaded pin 133. If spring loaded pins 133 are employed, each of support members 106,107 will include a bracket 134 having at least one lock hole 135 formed therethrough. Spring loaded pins 133 are located within each of tubing sections 129,130 as shown in FIG. 8 to engage lock hole 135, thereby placing step member 125 in a locked operating position. If pins 133 are disengaged from bracket 134, step member 125 is free to pivot to a collapsed position whereupon it becomes aligned with central assembly 101. While not required, additional lock holes may be optionally formed in bracket 134 in order to lock step member 125 in a collapsed position as well. As shown in FIG. 9, placing both pivoting steps 121,122 in collapsed positions and retracting both upper assembly 102 and lower assembly 103 within central assembly 101 allows for easy and convenient transportation and storage of the ladder module.

With reference to all of the foregoing embodiments, it will be appreciated that the ability of the ladder module to retract and extend offers advantages to hunters for several important reasons. First, it is much easier to transport multiple ladder modules to and from a hunting site when the ladder modules are in a retracted position. Second, based on the particular branch structure of the tree to be climbed, the climber has the option of either extending or retracting the ladder modules of his choice to make maximum use of the tree branches and/or the ladder modules. Finally, where the aforedescribed collapsible steps are employed, the transportation and storage of multiple ladder modules is greatly enhanced.

The overall concept of the foregoing embodiments of the invention is directed to providing a ladder system having a low-profile design for ease of carrying and storage. These designs also help the hunter in achieving a totally camouflaged appearance, because they are smaller and less bulky than competing designs. Furthermore, the adjustability enables the ladder modules to be placed within very fight spaces among tree limbs, contrary to other products seen in the prior art.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A portable ladder module for climbing a tree, comprising:

(a) an upper assembly having a first pair of support members attached to one another by a top step;

(b) a lower assembly having a second pair of support members attached to one another by a bottom step;

(c) a central assembly having a third pair of support members, wherein said upper and lower assemblies are independently slidable relative to said central assembly;

(d) first locking means operatively disposed between said upper assembly and said central assembly for selectively locking the position of said upper assembly relative to said central assembly in an extended position and a retracted position;

(e) second locking means operatively disposed between said lower assembly and said central assembly for selectively locking the position of said lower assembly relative to said central assembly in an extended position and a retracted position;

(f) means on said upper assembly for attaching said ladder module to a tree; and (g) means on said upper assembly and said lower assembly for stabilizing said ladder module against said tree, wherein a first portion of said stabilizing means is attached to said top step, and a second portion of said stabilizing means is attached to said bottom step; wherein said top step is lockingly pivotable relative to said upper assembly; and wherein said bottom step is lockingly pivotable relative to said lower assembly.

2. A portable ladder module for climbing a tree, comprising:

(a) an upper assembly having a first pair of support members attached to one another by a top step;

(b) a lower assembly having a second pair of support members attached to one another by a bottom step;

(c) a central assembly having a third pair of support members, wherein said upper and lower assemblies are independently slidable relative to said central assembly;

(d) first locking means operatively disposed between said upper assembly and said central assembly for selectively locking the position of said upper assembly relative to said central assembly in an extended position and a retracted position;

(e) second locking means operatively disposed between said lower assembly and said central assembly for selectively locking the position of said lower assembly relative to said central assembly in an extended position and a retracted position;

(f) means of said central assembly for attaching said ladder module to a tree; and (g) means on said upper assembly and said lower assembly for stabilizing said ladder module against said tree, wherein a first portion of said stabilizing means is attached to said top step, and a second portion of said stabilizing means is attached to said bottom step; wherein said top step is lockingly pivotable relative to said upper assembly; and wherein said bottom step is lockingly pivotable relative to said lower assembly.

* * * * *